US011434702B2

(12) United States Patent
Liu et al.

(10) Patent No.: US 11,434,702 B2
(45) Date of Patent: Sep. 6, 2022

(54) PLUG AND VALVE INTEGRATED CONE VALVE PUMP WITH COMBINED TYPE MOVABLE AND FIXED THREE CYLINDERS AND TWO SPIRAL CENTRALIZERS

(71) Applicant: QINGDAO UNIVERSITY OF TECHNOLOGY, Qingdao (CN)

(72) Inventors: Xinfu Liu, Qingdao (CN); Chunhua Liu, Qingdao (CN); Chao Zhou, Beijing (CN); Jianjun Wu, Xi'an (CN); Peng Gao, Tianjin (CN); Shousen Zhang, Tianjin (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 17/142,261

(22) Filed: Jan. 6, 2021

(65) Prior Publication Data

US 2021/0324688 A1 Oct. 21, 2021

(30) Foreign Application Priority Data

Apr. 15, 2020 (CN) ..... 202010294874.8

(51) Int. Cl.
*E21B 17/10* (2006.01)
*E21B 34/14* (2006.01)
*E21B 43/12* (2006.01)

(52) U.S. Cl.
CPC ..... *E21B 17/1071* (2013.01); *E21B 34/14* (2013.01); *E21B 43/127* (2013.01)

(58) Field of Classification Search
CPC .... E21B 17/1071; E21B 43/13; E21B 43/121; E21B 43/126; E21B 43/127
See application file for complete search history.

(56) References Cited

U.S. PATENT DOCUMENTS 2,061,480 A * 11/1936 Reginald ..... F16K 15/06 137/533.21
4,880,062 A * 11/1989 Bland ..... E21B 34/12 166/371

(Continued)

FOREIGN PATENT DOCUMENTS

CN 200943454 Y 9/2007
CN 102287358 A 12/2011

(Continued)

OTHER PUBLICATIONS dictionary.com Unabridged—Based on the Random House Unabridged Dictionary, © Random House, Inc. 2022 Fixed (Year: 2022).*
Collins English Dictionary—Fixed (Year: 2022).*

*Primary Examiner* — David Carroll

(57) ABSTRACT

The present invention relates to a plug and valve integrated cone valve pump with combined type movable and fixed three cylinders and two spiral centralizers, which is applied to suction working conditions in highly deviated well sections. It comprises three pump cylinders, which are combined type including two fixed cylinders and a dynamic cylinder, two centralizers, which are combined type including a dynamic spiral centralizer and fixed spiral centralizer, a fixed cone valve, a cylinder and plug integrated springing fixed cone valve, a fixed plunger and a movable guide rod cone valve to solve the problems such as stuck pump, eccentric wear between plunger and pump cylinder and valve leakage.

5 Claims, 9 Drawing Sheets

(56) References Cited

U.S. PATENT DOCUMENTS

| | | | | |
|---|---|---|---|---|
| 6,193,483 | B1 * | 2/2001 | Michael | E21B 43/121 417/567 |
| 6,220,358 | B1 * | 4/2001 | Leniek, Sr. | E21B 19/22 166/369 |
| 9,151,141 | B1 * | 10/2015 | Ippolito | E21B 43/00 |
| 2002/0179304 | A1 * | 12/2002 | Michael | E21B 43/385 166/369 |
| 2011/0300003 | A1 * | 12/2011 | Hofstatter | E21B 43/127 417/53 |
| 2016/0245417 | A1 * | 8/2016 | Boyd | G06F 16/00 |
| 2017/0145786 | A1 * | 5/2017 | Gronning | E21B 37/00 |
| 2017/0191356 | A1 * | 7/2017 | Steele | F04B 53/10 |

FOREIGN PATENT DOCUMENTS

| | | | |
|---|---|---|---|
| CN | 103452833 | A | 12/2013 |
| CN | 108916010 | A | 11/2018 |
| CN | 108953124 | A | 12/2018 |
| CN | 108953132 | A | 12/2018 |
| CN | 109162908 | A | 1/2019 |
| CN | 109356832 | A | 2/2019 |
| RU | 2353805 | C1 | 4/2009 |
| RU | 2012147966 | A | 5/2014 |

* cited by examiner

PLUG AND VALVE INTEGRATED CONE VALVE PUMP WITH COMBINED TYPE MOVABLE AND FIXED THREE CYLINDERS AND TWO SPIRAL CENTRALIZERS

CROSS-REFERENCE TO RELATED APPLICATION

This publication is made based on the Chinese patent application CN202010294874.8 filed on Apr. 15, 2020 with Chinese patent priority claimed, the full content of which is incorporated by reference herein.

FIELD OF THE INVENTION

The present invention relates to a sucker rod pump used for oil and gas exploitation in highly deviated well sections, and more specifically, to a plug and valve integrated cone valve pump with combined type movable and fixed three cylinders and two spiral centralizers.

BACKGROUND OF THE INVENTION

There are a lot of problems for the sucker rod pump at the highly deviated well sections of the horizontal wells and inclined wells during the stable production stage, such as severe eccentric wear between the pump cylinder and the plunger, difficulty to open and lagging reset for the fixed valve and traveling valve, leakage of oil, and pumps buried or stuck by sand, these problems make the service life and the efficiency of pumps decreased, and the pump inspection cycle shorter.

At present, the commonly used sucker rod pumps suitable for highly deviated wells in other countries mainly include rotating plunger pumps and spiral-flow plunger sand control pumps. The upward component force of the well fluid in the rotating plunger pump acts on the upper part of the spiral groove, and the plunger of the rotating plunger pump receives the torsion moment and rotates. The greater the angle of the spiral groove outside of the pump body, the greater the circumferential force on the plunger and the plunger rotates faster, which solves the problem of eccentric wear between the pump cylinder and plunger and effectively prevents sand sticking to a certain extent. The spiral-flow plunger sand control pump can remove the sand between the pump cylinder and the plunger, and the well fluid carrying the sand enters the outer oil tube through the internal flow channel of the plunger. The well fluid above the plunger is in a vortex state, thus the regular problems such as stuck pump and eccentric wear of the oil pump are solved, and service life of the pump is extended. The commonly used sucker rod pumps suitable for highly deviated wells in China mainly include the equal diameter sand-scraping and sand-control pumps and long plunger sand-control pumps. The plunger of the equal diameter sand-scraping and sand-control pump has a sand-scraping effect and scrapes the sand near the inner wall of the plunger falling in the plunger cavity, the plunger also has the characteristics of self-washing during the down stroke, so as to solve the problems of stuck pump and eccentric wear. The plunger of the long plunger sand-control pump is longer than the pump cylinder, and part of the plunger is always exposed above the pump cylinder, which can reduce the probability of sand entering the gap between the plunger and the pump cylinder. At the same time, the pump adopts a lateral oil inlet; an annular cavity is formed between the pump cylinder and the outer pipe to remove the sand, by which the problem of stuck pump by sand is solved. Because the inclination angles in the inclined well section of the horizontal well and the pump hanging position in the inclined well are too large, the valve balls of the above high deviated pumps still have problems such as ball valve setting lag and valve leakage in actual mining, and there is no specifically designed centering device for the plunger, so, there is still a certain amount of sand abrasion and eccentric wear between the plunger and the pump cylinder. At the same time, the plunger is still made of hard materials, and the bending and torsion performance of the plunger is poor, which is not suitable for highly deviated well sections and high oil viscosity working conditions.

Based on the numerical simulation results of the multiphase flow regime of the sucker rod pump in the highly deviated well section and the test results in the main oil and gas fields such as Sheng li Oilfield and Liao he Oilfield, and unconventional well fields such as the eastern margin of Ordos, a novel cone-valve pump equipment with multiple pump cylinders, automatic centralizers and plug and valve integrated structure has been developed to solve the problems of eccentric wear, stuck pump and pump valve leakage in the well sites.

SUMMARY OF THE INVENTION

In order to effectively solve the technical problems about high-efficiency pumping in the horizontal wells and inclined wells in the oil and gas exploitation field and overcome the defects and shortcomings of the existing sucker rod pump devices in the high deviated well sections, the present invention provides a plug and valve integrated cone valve pump with combined type movable and fixed three cylinders and two spiral centralizers used for oil and gas exploitation in the highly deviated well sections. The plug and valve integrated cone valve pump is comprised of combined type two fixed cylinders and one movable cylinder (movable and fixed three-cylinder body), combined type a movable spiral centralizer and a fixed spiral centralizer (movable and fixed double-centralizer), a fixed cone valve and a plunger integrated spring-loaded stationary cone valve, a fixed plunger and a movable cone valve guide rod (guide rod type traveling cone valve), the plug and valve integrated cone valve pump solves the technological difficulties such as stuck pump by sand when production operation in the horizontal wells and inclined wells under condition of low liquid volume, difficult to open and close pump valve under condition of low submergence depth, the eccentric wear of the plunger and the pump cylinder and the leakage of the pump valve in the highly deviated well sections.

The technical solution adopted by the present invention to solve the technical problems is to provide a plug and valve integrated cone valve pump with combined type movable and fixed three cylinders and two spiral centralizers, which is mainly composed of a movable and fixed three-cylinder body, a guide rod movable cone valve, a spring-loaded stationary cone valve, a movable and fixed double-centralizer, and a stationary plunger body. The plug and valve integrated cone valve pump adopts an axial symmetry cylinder body structure on the whole, which is connected to the tubing string and the air anchor through the movable and fixed three-cylinder body, and is connected with the central rod string through the movable cone valve guide rod, the movable cone valve guide rod, the combined type dual-movable-and-stationary-spiral-bodies centralizer and the intermediate movable pump cylinder move up and down with the central rod; the spring-loaded stationary cone valve and the fixed plunger are arranged in the cylinder cavity of the intermediate movable pump cylinder from top to bottom along the axial direction, and the spring-loaded stationary cone valve, the fixed plunger, the outer stationary pump cylinder and the internal stationary pump cylinder are fixed at the bottom of the tubing string.

The movable and fixed three-cylinder body adopts combined three-cylinder body and is composed of a movable pump cylinder and two stationary pump cylinders. Relied on the internal stationary pump cylinder, the spring-loaded stationary cone valve and the fixed plunger are connected together as a whole, the movable cone valve guide rod and the movable and fixed double-centralizer are connected together as a whole through the intermediate movable pump cylinder, by which it is avoid that sand falls into the annular clearance between the movable pump cylinder and the fixed plunger and causes abrasion. The movable and fixed three-cylinder body includes the outer stationary pump cylinder, the intermediate movable pump cylinder, the internal stationary pump cylinder and the pump cylinder coupling.

Both ends of the outer stationary pump cylinder, the intermediate movable pump cylinder and the internal stationary pump cylinder are all with sealing pipe threads, which are arranged concentrically from the outside to the inside along the radial direction. The outer stationary pump cylinder and the internal stationary pump cylinder are the long and thick cylinder and the short and thin cylinder respectively, and are fixed to the bottom of the tubing string through the pump cylinder coupling. The intermediate movable pump cylinder adopts a long and thin cylinder and is connected to the bottom of the central rod string through a movable cone valve guide rod. The intermediate movable pump cylinder is successively provided with a variable-diameter movable cylinder joint, an upper cylinder limiting collar and a lower cylinder limiting collar along the axial direction. The lower cylinder limiting collar realizes the axial alignment of the centering coupling, and the upper cylinder limiting collar realizes the lower limit of the upper movable spiral. The outer wall of the variable-diameter movable cylinder joint is connected with the movable cone valve cover and the movable spiral body centering limiting collar through threads. The annular cavity inner wall of the variable-diameter movable cylinder joint consists of two cylindrical surfaces and a conical surface, the top cylindrical surface diameter of the annular cavity inner wall of the variable-diameter movable cylinder joint is equal to the diameter of the movable valve hole in the movable cone valve seat, and the lower part cylindrical surface of the annular cavity inner wall of the variable-diameter movable cylinder joint is located on the same cylindrical surface as the annular cavity inner wall of the intermediate movable pump cylinder. The intermediate movable pump cylinder slid circularly and accurately along the cylinder cavity of the outer stationary pump cylinder relied on the layered cylindrical surface moving pair of the fixed plunger and the single plate cylindrical surface moving pair of the flow guide centering plate, combined with the dynamic pressure liquid film of the upper movable spiral body and the stable liquid film of the lower stationary spiral body.

The pump cylinder coupling is a circular box shape with an opening facing upward, and the bottom of the pump cylinder coupling is provided with the coupling guide hole and the desilting annular groove along the radial direction from the inside to the outside, the two walls of the desilting annular groove of the pump cylinder coupling adopt cylindrical surfaces and are arranged coaxially with the hole walls of the pump cylinder coupling guide hole, the bottom surface of the desilting annular groove is flat and intersects at right angles with the center line of the external pump cylinder, and the diameter of the coupling guide hole is equal to the inner diameter of the internal stationary pump cylinder.

The spring-loaded stationary cone valve and the fixed plunger adopt integrated structure of fixed cone valve and plunger, the fixed cone valve opens and closes smoothly through the assists of stationary cone valve guide rod and stationary cone valve springs, which can solve the problem of difficulty in opening of the pump valve and loose closing of the pump valve in the highly inclined well sections. The integrated structure includes stationary cone valve body, stationary cone valve seat; stationary cone valve hood, flow guide centering plate, and stationary cone valve guide rod and stationary cone valve spring. The stationary cone valve spring adopts a compression spring, and its maximum elastic force is equal to the sum of the force of gravity of the stationary cone valve body and the guide rod integrated with fixed cone valve.

The outer peripheral surface of the stationary cone valve body is successively provided with a lower spring retaining groove and a stationary valve body sealing surface, the stationary valve body sealing surface and the stationary valve seat sealing surface of the stationary cone valve body adopt the same taper inverted cone surfaces, and the conical surface diameter of the large end circular surface of the stationary valve body sealing surface is less than the cylindrical surface diameter of the cavity wall of the stationary valve guide cavity, and the small end circular surface diameter of the stationary valve body sealing surface is less than the hole diameter of the stationary valve hole in the stationary cone valve seat. The annular cavity inner wall of the stationary cone valve body adopts a variable diameter surface and is connected to the stationary rod joint of the stationary cone valve guide rod.

The stationary cone valve seat adopts a circular ring structure, the annular cavity inner wall of the stationary cone valve seat is successively provided with a stationary valve seat sealing surface and a stationary valve hole along the axial direction, and the sealing surface of the fixed valve seat and the stationary valve body sealing surface are precisely matched to form a stationary cone valve sealing annular band. The width of the sealing ring of the fixed cone valve is greater than the one third of cone height where the sealing surface is located in the fixed valve body.

The stationary cone valve hood is a circular box shape with an opening facing downward. The bottom of the box of the stationary cone valve hood is provided with an upper spring groove and a circular hole is drilled in the center of the bottom of the box. The upper spring groove of the stationary cone valve hood and the lower spring groove of the stationary cone valve body are matched with the stationary cone valve spring to realize the upper and lower bidirectional limit of the stationary cone valve spring. The annular cavity inner wall of the stationary cone valve hood is successively provided with a stationary valve seat cavity, a stationary valve guide cavity and a stationary valve cover hole along the axial direction. The stationary cone valve seat is placed in the stationary valve seat cavity of the stationary cone valve hood and axially fixed through the internal stationary pump cylinder. The stationary valve guide cavity wall of the stationary cone valve hood adopts a cylindrical surface and is in communication with the stationary valve cover hole. The stationary valve cover hole of the stationary cone valve hood adopts a circular channel and is evenly distributed along the circumferential direction. The valve cover hole is arranged obliquely, so that the liquid flow in the stationary pump cylinder successively flows through the stationary valve hole and the stationary valve guide cavity, and is discharged to the cylinder cavity of the intermediate movable pump cylinder through the stationary valve cover hole and the arched guide hole.

The stationary cone valve guide rod is successively provided with a stationary rod cover, a stationary rod body and a stationary rod joint along the axial direction, the stationary rod joint connects the stationary cone valve guide rod and the stationary cone valve body together as a whole through threads, and the outer peripheral surface of the stationary rod body is precisely matched with the both circular hole walls in the bottom of the stationary cone valve hood and on the flow guide centering plate simultaneously, the stationary cone valve guide rod realizes accurate reciprocating sliding relied on the dual-valve cylindrical surface moving pair, space is kept between the stationary rod cover and the fixed rod shaft shoulder and the upper end surface of the flow guide centering plate.

The flow guide centering plate adopts a round copper plate, and the outer peripheral surface of the flow guide centering plate is precisely matched with the annular cavity inner wall of the intermediate movable pump cylinder to form a single plate cylindrical surface moving pair. The center part of the flow guide centering plate is drilled with a circular hole and there are arched guide holes evenly distributed along the circumferential direction around the circular hole. The cross section of each arched guide hole in the axial direction is comprised of a semicircle and a rectangle. The sum of the sectional area of each arched guide hole in the flow guide centering plate, the sectional area of the stationary valve hole in the stationary cone valve seat, and the sectional area of the stationary valve cover hole in the stationary cone valve hood are equal.

The fixed plunger adopts a fixed short plunger, which is combined with the intermediate movable pump cylinder to prevent sand from depositing to the top of the fixed plunger. The fixed plunger reduces the friction loss between the fixed plunger and the intermediate movable pump cylinder relied on the layered anti-wear ring.

The annular cavity inner wall of the fixed plunger is threaded and connected to the upper part of the internal stationary pump cylinder, and the outer peripheral surface of the fixed plunger is successively arranged with a plunger capturing cone and a anti-wear groove along the axial direction. The cross-section of the anti-wear groove of the fixed plunger is rectangular, all anti-wear grooves are arranged in layers at equal intervals, and the outer ring wall surfaces of the fixed plunger between the anti-wear grooves are matched with the annular cavity inner wall of the intermediate movable pump cylinder to form layered cylindrical surface moving pair; The anti-attrition groove in the fixed plunger is embedded with a anti-wear ring, and the anti-wear ring adopts a split bearing bush, the material of the anti-wear ring is made of anti-wear alloy, the cylindrical diameter of the outer peripheral surface of the anti-wear ring is the same as the annular clearance of between the intermediate movable pump cylinder and the fixed plunger, and the outer peripheral surface of the anti-wear ring closely fits with the annular cavity inner wall of the intermediate movable pump cylinder, by which, the frictional loss between the fixed plunger and the intermediate movable pump cylinder is reduced.

The guide rod movable cone valve adopts a guide rod type traveling cone valve and smoothly opens and closes through the guiding function of the guide rod integrated with movable cone valve, by which the problem of pump valve leakage in highly deviated well section can be solved. The guide rod movable cone valve includes the movable cone valve body, the movable cone valve seat, the movable cone valve cover and the guide rod integrated with movable cone valve.

The outer peripheral surface of the movable cone valve body is provided with a sealing surface, the movable valve body sealing surface and the movable valve seat sealing surface of the movable cone valve body adopt the same taper inverted cone surfaces, and the conical surface diameter of the large end circular surface of the movable valve body sealing surface is less than the cylindrical surface diameter of the cavity wall of the movable valve guide cavity, and the small end circular surface diameter of the movable valve body sealing surface is less than the hole diameter of the movable valve hole in the movable cone valve seat. The movable cone valve seat adopts a annular ring body, the annular cavity inner wall of the movable cone valve seat is successively provided with the movable valve seat sealing surface and the movable valve hole along the axial direction, the sealing surface of the movable cone valve seat is precisely matched with and the sealing surface of the movable valve body to form a movable cone valve sealing annular band, by which the problem of pump valve leakage in highly deviated well section can be solved. The cross-sectional area of the movable valve hole in the movable cone valve seat is equal to the sum of the cross-sectional area of each valve cover hole in the movable cone valve cover.

The movable cone valve cover adopts a thick-walled cylinder, and the annular cavity inner wall of the movable cone valve cover is successively provided with the movable valve seat cavity, the movable valve guide cavity, the movable valve cover hole and the variable-diameter threaded joint along the axial direction. The movable cone valve cover is placed in the movable valve seat cavity of the movable cone valve cover and is axially fixed through the variable-diameter movable cylinder joint. Both ends of the variable-diameter threaded joint are with threads of different nominal diameters, and the central rod string is connected to the movable cone valve guide rod through threads. The cavity wall of the movable valve guide cavity adopts a cylindrical surface and is in communication with the movable valve cover hole. The movable valve cover hole in the movable cone valve cover adopts a tapered channel and is evenly distributed along the circumferential direction. Each movable cone valve cover hole is arranged obliquely along the circumferential direction, so that the liquid flow in the intermediate movable pump cylinder successively flows through the movable valve hole and the movable valve guide cavity, and then is injected into the cylinder cavity of the outer stationary pump cylinder after decompressed and accelerated passed through the movable valve cover hole to avoid sand deposition.

The movable cone valve guide rod is successively provided with a movable rod body and a movable rod joint along the axial direction. The movable rod joint of the movable cone valve guide rod is connected with the movable cone valve cover through threads, and the outer peripheral surface of the movable rod body is precisely matched with the annular cavity inner wall of the movable cone valve body to form a single valve cylindrical surface moving pair, and the movable cone valve guide rod realizes the guiding function relied on the single valve cylindrical surface moving pair.

The combined type movable and fixed double-centralizer adopts a combined type movable and fixed double-spiral centering structure, which realizes the follow-up centering of the intermediate movable pump cylinder through the dynamic pressure liquid film of the upper movable spiral body, and realizes the spiral centering of the intermediate movable pump cylinder combined with the stable liquid film in the lower stationary spiral body. The lower stationary spiral body of the movable and fixed double-centralizer drains the sand at the bottom of the outer stationary pump cylinder to the desilting annular groove in time through spiral stirring, by which the eccentric wear problem between the stationary plunger body and the intermediate movable pump cylinder is solved. The combined type movable and fixed double-centralizer includes an upper movable spiral, a lower stationary spiral body, a movable spiral body centering limiting collar and a lower movable spiral body centering coupling.

The upper movable spiral body adopts a rotating spiral tooth impeller, the lower stationary spiral body adopts a stationary spiral tooth impeller, the upper movable spiral body consists of the upper spiral teeth body and an upper centering base tube, and the upper spiral teeth are evenly distributed on the outer peripheral surface of the upper centering base tube along the circumferential direction. The lower spiral body consists of the lower spiral teeth body and a lower centering base tube. The lower spiral teeth are evenly distributed on the outer peripheral surface of the lower centering base tube along the circumferential direction. The inner diameter of the lower centering base tube is equal to the inner diameter of the intermediate movable pump cylinder. Each spiral tooth line of the upper spiral tooth is a spiral line that expands along the outer peripheral surface of the upper centering base tube, and each spiral tooth line of the lower spiral tooth is a spiral line that expands along the outer peripheral surface of the lower centering base tube.

Each spiral tooth space of the upper spiral teeth gradually decreases from bottom to top along the tooth line and is trapezoid at where the spiral tooth is perpendicular to end face of normal plane of the spiral tooth line, at the same time, the top surface of each spiral tooth of the upper spiral tooth body adopts a clearance fit with the outer stationary pump cylinder wall, the annular cavity inner wall of the upper centering base tube adopts a clearance fit with the intermediate movable pump cylinder wall, too, so that the upper spiral teeth guide the liquid flow carrying sand in the upper spiral teeth space to the cavity above the intermediate movable pump cylinder in time. The upper spiral tooth body is used to reduce the amount of sand deposition in the annular cavity between the outer stationary pump cylinder and the intermediate movable pump cylinder. At the same time, the liquid flow forms a dynamic pressure liquid film between the upper movable spiral body and the outer stationary pump cylinder.

Each spiral tooth of the lower spiral tooth body is rectangular on the normal surface end surface perpendicular to the tooth line, and the cross-sectional area of the normal surface end surface gradually increases along the tooth line from bottom to top, whereby the lower spiral tooth body The cross-sectional area of the lower spiral tooth gap between each spiral tooth gradually decreases from bottom to top along the tooth line. The lower spiral tooth body in time spirally stirs the liquid flow at the bottom of the annular cavity between the external pump cylinder and the internal pump cylinder and drains the sand particles. To the desilting annular groove of the pump cylinder coupling, at the same time, a clearance fit is adopted between the top surface of each spiral tooth of the lower spiral tooth body and the cylinder wall of the external pump cylinder, and the liquid flow is on the tooth top surface of the lower spiral tooth body. A stable liquid film is formed between the outer stationary pump cylinder and the cylinder wall, so as to realize the spiral centering of the intermediate movable pump cylinder.

The annular cavity inner wall lower part of the lower centering base tube of the lower stationary spiral body is milled with a centering capturing conical surface. The centering capturing conical surface in the lower stationary spiral body is matched with the plunger capturing conical surface in the fixed plunger, and both of them has and has the same taper, by which the movable and fixed double-centralizer can dock with the fixed plunger quickly in the pit. The top surface of the spiral teeth of the lower spiral teeth are provided with the anti-collision cone surfaces, the anti-collision cone surfaces adopt the inverted cone surface shape to avoid the movable and fixed double-centralizer colliding the tubing string wall or the cylinder wall of the outer stationary pump cylinder during the installation operation in the pit.

The movable spiral body centering limiting collar adopts a double-ring structure to realize the upper limit position of the upper movable spiral body, the annular cavity inner wall of the lower movable spiral body centering coupling is with sealing pipe threads and connects the lower stationary spiral body and the intermediate movable pump cylinder together. The outer peripheral surface diameter of the lower movable spiral body centering coupling is equal to the outer peripheral surface diameter of the upper cylinder limiting collar and the outer peripheral surface diameter of the movable spiral body centering limiting collar.

In the upstroke suction operation of the spiral centering plug-valve integrated cone valve, relied on the layered cylindrical surface moving pair, the single plate cylindrical surface moving pair, the dynamic pressure liquid film of the upper movable spiral body and the stable liquid film of the lower stationary spiral body, the center movable pump cylinder realizes follow-up centering and spiral centering, and accurately slides upwards with the central rod, the flow pressure in the cylinder cavity of the intermediate movable pump cylinder decreases, and the fixed cone valve opens smoothly through the assists of stationary cone valve guide rod and stationary cone valve springs, the liquid flow successively flows through the stationary valve hole and the stationary valve guide cavity, and is diverted to the cylinder cavity of the intermediate movable pump cylinder through the stationary valve cover hole and the arched guide hole, at the same time, the liquid flow above the spiral body follows into the tubing string cavity with the central rod string; in the down stroke, the intermediate movable pump cylinder realizes follow-up centering and spiral centering and accurately slides downwards with the central rod string, the flow pressure inside the intermediate movable pump cylinder cavity increases, and the movable cone valve integrated with the guide rod opens smoothly relied on the guiding function of the movable cone valve guide rod. The liquid flow successively flows through the movable valve hole and the movable valve guide cavity, and then is injected into the cylinder cavity of the outer stationary pump cylinder after decompressed and accelerated passed through the movable valve cover hole to avoid sand deposition. The upper spiral teeth guides the liquid flow to the cylinder cavity above the intermediate movable pump cylinder, and the lower spiral teeth drains the sand to the desilting annular groove through spiral stirring.

The technical effect that can be achieved by the present invention is that the plug and valve integrated cone valve pump uses three pump cylinders, which are combined type including two fixed cylinders and a dynamic cylinder, two centralizers, which are combined type including a dynamic spiral centralizer and fixed spiral centralizer, a fixed cone valve, a cylinder and plug integrated spring-loaded stationary cone valve, a fixed plunger and a movable guide rod cone valve to solve the technological difficulties such as stuck pump by sand when production operation in the horizontal wells and inclined wells under condition of low liquid volume, difficult to open and close pump valve under condition of low submergence depth, the eccentric wear of the plunger and the pump cylinder and the leakage of the pump valve in the highly deviated well sections. The combined three-cylinder body avoids sand falling into the annular clearance between the intermediate movable pump cylinder and the fixed plunger to cause wearing relied on one movable pump cylinder and two stationary pump cylinders. The fixed plunger adopts a fixed short plunger, which is combined with the intermediate movable pump cylinder to prevent sand from depositing to the top of the fixed plunger. The fixed plunger reduces the friction loss between the fixed plunger and the intermediate movable pump cylinder relied on the layered anti-wear ring. The spring-loaded stationary cone valve adopts a springing type fixed cone valve, which make the fixed cone valve opened and closed smoothly through the assists of stationary cone valve guide rod and stationary cone valve springs. The movable cone valve guide rod opens and closes smoothly through the guiding action of movable cone valve guide rod. The two movable and fixed centralizers realize the follow-up centering and spiral centering of the intermediate movable pump cylinder through the dynamic pressure liquid membrane of the upper movable spiral and the fixed liquid membrane of the lower stationary spiral body. The sand is drained to the annular sand furrow in time through spiral stirring.

BRIEF DESCRIPTION OF THE PICTURES

The present invention is further described in the following embodiments, but is not limited to these embodiments.

In the Figures, 1—central rod, 2—guide rod movable cone valve, 3—spring-loaded stationary cone valve, 4—fixed plunger, 5—dual-movable-and-stationary-spiral-bodies centralizer, 6—combined three-cylinder body, 7—outer stationary pump cylinder, 8—intermediate movable pump cylinder, 9—inner stationary pump cylinder, 10—pump cylinder coupling, 11—coupling guide hole, 12—desilting annular groove, 13—lower cylinder limiting collar, 14—upper cylinder limiting collar, 15—variable-diameter movable cylinder joint, 16—stationary cone valve guide rod, 17—flow guide centering plate, 18—stationary cone valve hood, 19—stationary cone valve spring, 20—stationary cone valve body, 21—stationary cone valve seat, 22—stationary cone valve sealing annular band, 23—arched guide hole, 24—single plate cylindrical surface moving pair, 25—dual-valve cylindrical surface moving pair, 26—stationary valve guide cavity, 27—stationary valve cover hole, 28—stationary valve seat cavity, 29—stationary valve hole, 30—stationary valve seat sealing surface, 31—stationary valve body sealing surface, 32—lower spring groove, 33—stationary rod joint, 34—upper spring groove, 35—stationary rod body, 36—stationary rod cover, 37—fixed plunger, 38—anti-wear ring, 39—anti-wear groove, 40—layered cylindrical surface moving pair, 41—plunger capturing cone, 42—movable cone valve cover, 43—movable cone valve guide rod, 44—movable cone valve body, 45—movable cone valve seat, 46—single valve cylindrical surface moving pair, 47—movable cone valve sealing annular band, 48—variable-diameter threaded joint, 49—movable valve cover hole, 50—movable valve guide cavity, 51—movable valve seat cavity, 52—movable rod joint, 53—movable rod body, 54—movable valve hole, 55—movable valve seat sealing surface, 56—movable valve body sealing surface, 57—movable spiral body centering limiting collar, 58—upper movable spiral body, 59—lower movable spiral body centering coupling, 60—lower stationary spiral body, 61—upper spiral tooth body, 62—upper centering base tube, 63—upper spiral tooth space, 64—lower spiral tooth body, 65—lower centering base tube, 66—anti-collision conical surface, 67—centering capturing conical surface, 68—lower spiral tooth pitch.

DETAILED DESCRIPTION OF THE PREFERRED EMBODIMENTS

Figure 1:
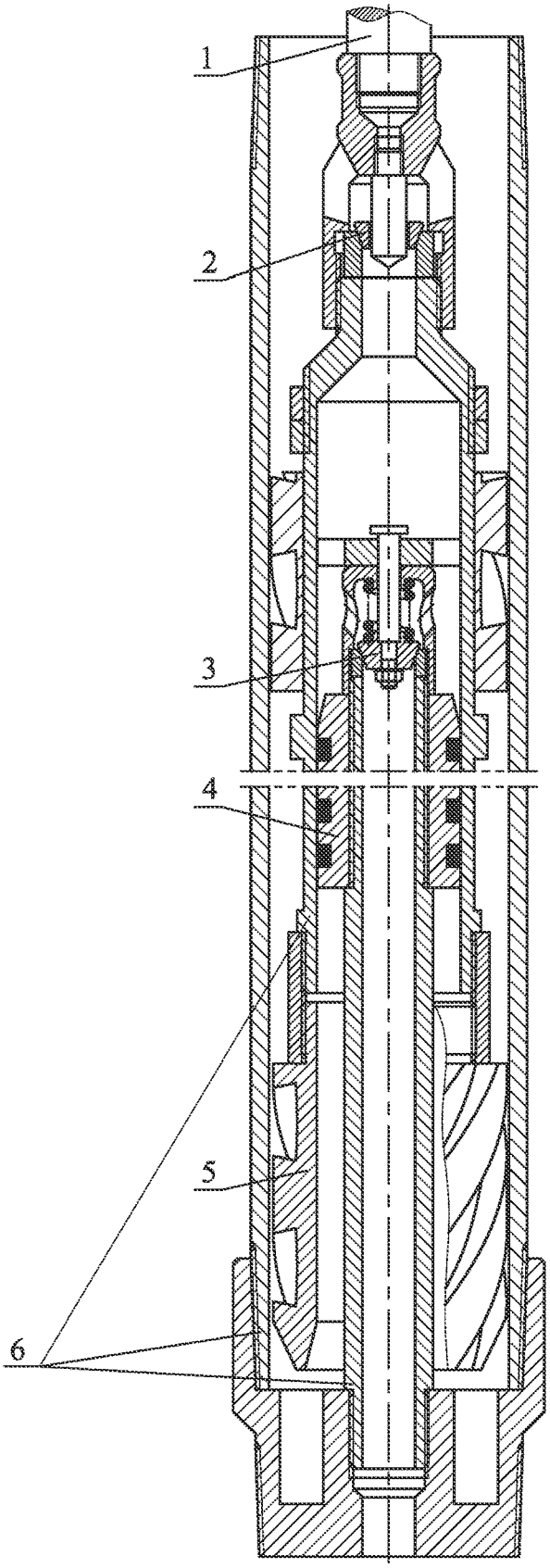
FIG. 1 is a typical structural sketch of the plug and valve integrated cone valve pump with combined type movable and fixed three cylinders and two spiral centralizers proposed by the present invention.

In FIG. 1, the plug and valve integrated cone valve pump with combined type movable and fixed three cylinders and two spiral centralizers is mainly composed of the movable cone valve integrated with the guide rod 2, the spring-loaded stationary cone valve 3, the fixed plunger 4, the movable and fixed double-centralizer 5 and the combined three-cylinder body 6, the plug and valve integrated cone valve pump uses the combined type two fixed cylinders and one movable cylinder (movable and fixed three-cylinder body 6), combined type a movable spiral centralizer and a fixed spiral centralizer (movable and fixed double-centralizer 5), a fixed cone valve and a plunger integrated spring-loaded stationary cone valve 3, a fixed plunger 4 and a movable cone valve guide rod (guide rod type traveling cone valve 2) to solve the technological difficulties such as stuck pump by sand when production operation in the horizontal wells and inclined wells under condition of low liquid volume, difficult to open and close pump valve under condition of low submergence depth, the eccentric wear of the plunger and the pump cylinder and the leakage of the pump valve in the highly deviated well sections.

In FIG. 1, The plug and valve integrated cone valve pump with combined type movable and fixed three cylinders and two spiral centralizers adopts an axial symmetry cylinder body structure on the whole, which is connected to the tubing string and the air anchor through the movable and fixed three-cylinder body 6, and is connected with the central rod string 1 through the movable cone valve integrated with the guide rod 2, the movable cone valve integrated with the guide rod 2, the combined type movable and fixed double-centralizer 5, and the intermediate movable pump cylinder of the movable and fixed three-cylinder body 6 move up and down with the central rod 1; the spring-loaded stationary cone valve 3 and the fixed plunger 4 are arranged in the cylinder cavity of the intermediate movable pump cylinder of the movable and fixed three-cylinder body 6 from top to bottom along the axial direction, and the spring-loaded stationary cone valve 3, the fixed plunger 4, the outer stationary pump cylinder and the internal stationary pump cylinder of the movable and fixed three-cylinder body 6 are fixed at the bottom of the tubing string.

In FIG. 1, before the assembly of the plug and valve integrated cone valve pump with combined type movable and fixed three cylinders and two spiral centralizers, the externally stationary pump cylinder of the movable and fixed three-cylinder body 6 and the outer peripheral surface of the pump cylinder coupling are painted to prevent corrosion, the annular cavity inner walls of the outer stationary pump cylinder, the intermediate movable pump cylinder and the internal stationary pump cylinder of the movable and fixed three-cylinder body 6 are respectively to conduct chemical plating treatment, the outer peripheral surfaces of the intermediate movable pump cylinder and the internal stationary pump cylinder, and the outer peripheral surface of the fixed plunger of the stationary plunger body 4, and the upper movable spiral body and the lower stationary spiral body of the movable and fixed double-centralizer 5 are to conduct spraying welding treatment respectively. The fixed plunger of the stationary plunger body 4 is placed in the intermediate movable pump cylinder of the movable and fixed three-cylinder body 6, at the same time, the upper movable spiral body and the lower stationary spiral body of the movable and fixed double-centralizer 5 are placed in the outer stationary pump cylinder of the movable and fixed three-cylinder body 6, when the devices above are pulled back and forth, they should be flexible to rotate and slide without obstruction. The stationary cone valve guide rod of the spring-loaded stationary cone valve 3 is inserted into the guide centering plate and the stationary cone valve hood, and the movable cone valve guide rod of the movable cone valve integrated with the guide rod 2 inserts the movable cone valve body, when the devices above are pulled back and forth, they should be flexible to rotate and slide without obstruction. Keep the inner walls of the outer stationary pump cylinder, the intermediate movable pump cylinder and the internal stationary pump cylinder of the movable and fixed three-cylinder body 6, the lower stationary spiral body of the movable and fixed double-centralizer 5 and the movable cone valve cover of the movable cone valve integrated with the guide rod 2 and the stationary cone valve hood of the spring-loaded stationary cone valve 3 clean, and finally check whether the upper movable spiral body and the lower stationary spiral body of the movable and fixed double-centralizer 5 are damaged, and check whether all threaded connections are firm and non-rust.

In FIG. 1, in the assembly operation of the plug and valve integrated cone valve pump with combined type movable and fixed three cylinders and two spiral centralizers, the anti-wear ring of the stationary plunger body 4 is embedded into the anti-wear groove of the fixed plunger, and the stationary cone valve spring of the fixed cone valve 3 is integrated with the stationary cone valve hood and the stationary cone valve body. The stationary cone valve guide rod of the spring-loaded stationary cone valve 3 is inserted into the guide centering plate and the stationary cone valve hood and is connected with the stationary cone valve body through threads, and then the stationary cone valve seat is placed in the stationary cone valve hood and successively connects the stationary plunger body 4 and the spring-loaded stationary cone valve 3 with the upper part of the internal stationary pump cylinder of the movable and fixed three-cylinder body 6 through threads, after that, the outer stationary pump cylinder and the internal stationary pump cylinder of the movable and fixed three-cylinder body 6 are connected together as a whole through the pump cylinder coupling. Next, the lower stationary spiral body of the movable and fixed double-centralizer 5 is connected to the bottom of the intermediate movable pump cylinder through a lower movable spiral body centering coupling, the upper movable spiral body is sleeved on the upper part of the intermediate movable pump cylinder and the movable spiral body centering limiting collar is tightened, after that, the movable cone valve guide rod of the guide rod movable cone valve 2 is connected with the movable cone valve cover through threads, and then the movable cone valve body and the movable cone valve seat are successively placed into the movable cone valve cover, and the guide rod movable cone valve 2 is connected to the top of the intermediate movable pump cylinder through threads.

Figure 2:
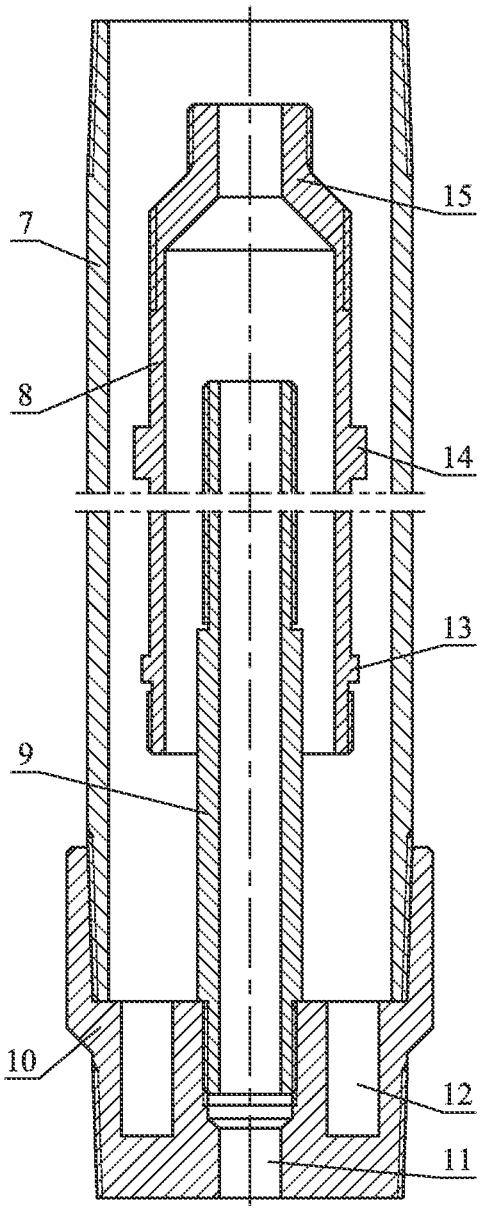
FIG. 2 is a structural sketch of the movable and fixed three-cylinder body in the plug and valve integrated cone valve pump with combined type movable and fixed three cylinders and two spiral centralizers.

In FIG. 2, the movable and fixed three-cylinder body 6 includes the outer stationary pump cylinder 7, the intermediate movable pump cylinder 8, the internal stationary pump cylinder 9 and the pump cylinder coupling 10. The specifications of the outer stationary pump cylinder 7 and the pump cylinder coupling 10 are adjusted with the pipe diameter of the tubing string. Factors such as the maximum stroke length of the plug valve integrated cone valve pump, the axial length of the stationary plunger body 4 and the anti-impact stroke need to be considered for the axial length design of the intermediate movable pump cylinder 8. Factors such as liquid production capacity in the oil field and bottom pressure need to be considered for the diameter design of the coupling guide hole 11 and the inner diameter design of the internal stationary pump cylinder 9.

In FIG. 2, in the movable and fixed three-cylinder body 6, the spring-loaded stationary cone valve 3 and the stationary plunger body 4 are connected together as a whole relied on the internal stationary pump cylinder 9, and the guide rod movable cone valve 2 and the movable and fixed double-centralizer 5 are connected together as a whole through the intermediate movable pump cylinder 8 to avoid sand from falling into the annular clearance between the intermediate movable pump cylinder 8 and the stationary plunger body 4 to cause wear. The outer stationary pump cylinder 7 and the internal stationary pump cylinder 9 are connected together as a whole through the pump cylinder coupling 10. The box bottom of the pump cylinder coupling 10 is successively provided with the coupling guide hole 11 and the desilting annular groove 12 from the inside to the outside along the radial direction. The lower cylinder limiting collar 13 realizes the axial alignment of the lower movable spiral body centering coupling of the movable and fixed double-centralizer 5, the upper cylinder limiting collar 14 realizes the lower limit of the upper movable spiral body of the movable and fixed double-centralizer 5, and the outer wall of the variable-diameter movable cylinder joint 15 is connected with the movable cone valve cover of the guide rod movable cone valve 2 and the movable spiral body centering limiting collar of the movable and fixed double-centralizer 5 respectively through threads.

Figure 3:
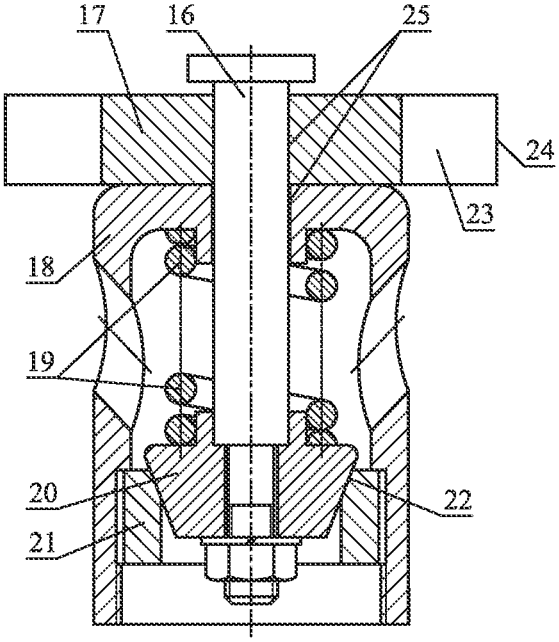
FIG. 3 is a structural sketch of the spring-loaded stationary cone valve in the plug and valve integrated cone valve pump with combined type movable and fixed three cylinders and two spiral centralizers.
Figure 4:
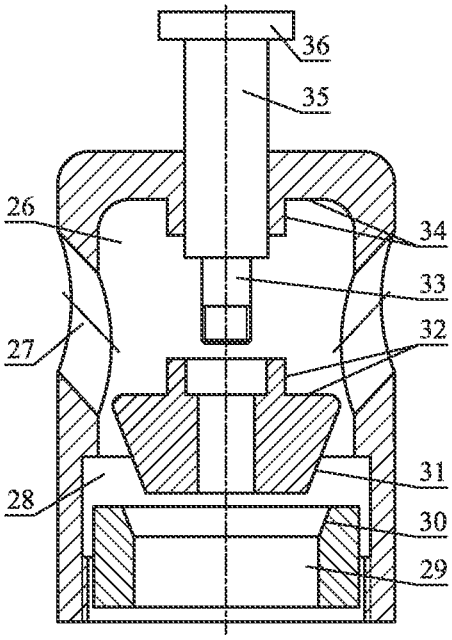
FIG. 4 is a structural sketch for the stationary cone valve body, the stationary cone valve seat, the stationary cone valve hood and the stationary cone valve guide rod in the spring-loaded stationary cone valve.

In FIGS. 3 and 4, the spring-loaded stationary cone valve 3 includes the stationary cone valve guide rod 16, the flow guide centering plate 17, the stationary cone valve hood 18, the stationary cone valve spring 19, the stationary cone valve body 20 and the stationary cone valve seat 21, the stationary cone valve body 20 and the stationary cone valve seat 21 are matched and selected based on the diameter of the coupling guide hole 11 and the inner diameter of the internal stationary pump cylinder 9. The specification of the flow guide centering plate 17 is consistent with the inner diameter of the intermediate movable pump cylinder 8. When selecting the specification of the stationary cone valve spring 19, factor such as the sum of the gravity of the stationary cone valve guide rod 16 and the stationary cone valve body 20 need to be considered, when designing the sum of the cross-sectional area of the flow guide centering plate 17 and each arched guide hole 23, the cross-sectional area of the stationary valve hole 29 of the stationary cone valve seat 21, and the sum of the cross-sectional area of each stationary valve cover hole 27 of the stationary cone valve hood 18, factors such as liquid production capacity in the oil field, bottom hole pressure need to be considered.

In FIGS. 3 and 4, the spring-loaded stationary cone valve 3 assists the stationary cone valve body 20 on the stationary cone valve seat 21 to smoothly open and close through the stationary cone valve guide rod 16 and the stationary cone valve spring 19, so as to solve the problem of difficulty in opening of the pump valve and loose closing of the pump valve in the highly inclined well sections, the spring-loaded stationary cone valve 3 is opened in the upstroke and is closed in the down stroke, the stationary cone valve body sealing surface 31 of the stationary cone valve body 20 and the stationary valve seat sealing surface 30 of the stationary cone valve seat 21 form the stationary cone valve sealing annular band 22, the upper spring groove 34 of the stationary cone valve hood 18 and the lower spring groove 32 of the stationary cone valve body 20 are simultaneously matched with the stationary cone valve spring 19 to realize the upper and lower bidirectional limit of the stationary cone valve spring 19, the sum of the cross-sectional area of each arched guide hole 23 of the guide centering plate 17, the cross-sectional area of the stationary valve hole 29 of the stationary cone valve seat 21 and the sum of the cross-sectional area of each stationary valve cover hole 27 of the stationary cone valve hood 18 are equal, the flow guide centering plate 17 and the intermediate movable pump cylinder 8 form the single-plate cylindrical sliding pair 24. The stationary rod joint 33 is connected with the stationary cone valve guide rod 16 and the stationary cone valve body 20 together as a whole. The stationary rod body 35, the stationary cone valve hood 18 and the flow guide centering plate 17 form the dual-valve cylindrical surface moving pair 25, and the stationary cone valve guide rod 16 is based on the double-valve cylindrical sliding pair 25 to achieve precise reciprocating sliding, the stationary rod body 35 and the stationary rod cover 36 form a shaft shoulder where the cross section changes, the stationary cone valve seat 21 is placed in the stationary valve seat cavity 28 and is axially fixed through the internal stationary pump cylinder 9, and the stationary valve guide cavity 26 is in communication with the stationary valve cover hole 27.

Figure 5:
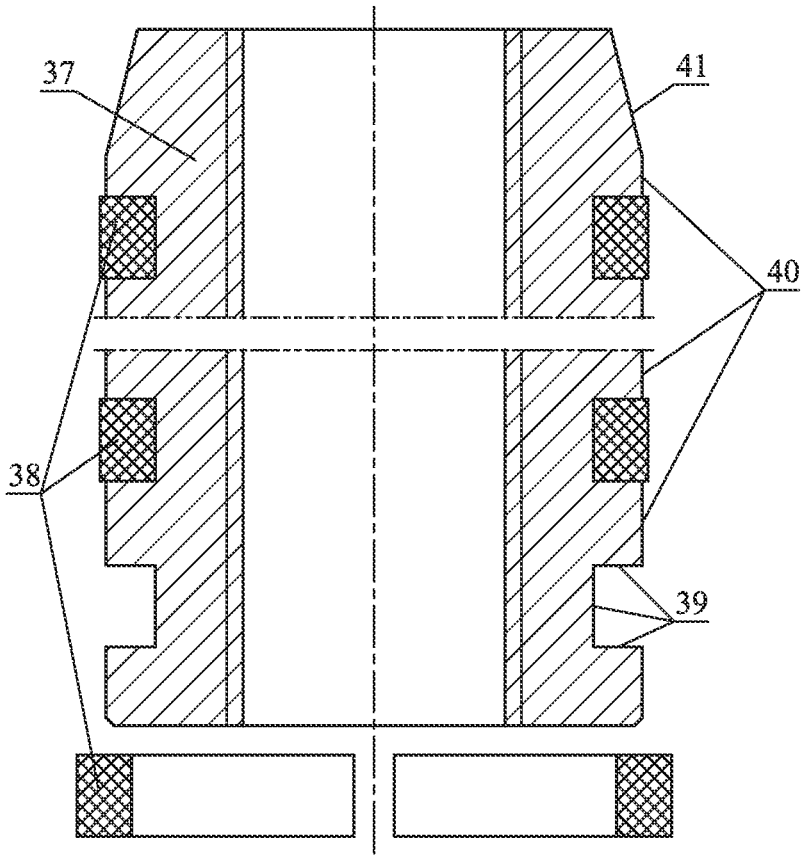
FIG. 5 is a structural sketch of the fixed plunger in the plug and valve integrated cone valve pump with combined type movable and fixed three cylinders and two spiral centralizers.

In FIG. 5, the specifications of the fixed plunger 37 and the anti-wear ring 38 of the stationary plunger body 4 are consistent with the inner diameter of the intermediate movable pump cylinder 8. The specifications of the anti-wear ring 38 are adjusted based on the annular clearance between the fixed plunger 37 and the intermediate movable pump cylinder 8.

In FIG. 5, the stationary plunger body 4 is matched with the intermediate movable pump cylinder 8 to realize the suction and lifting of the liquid flow, and prevent sand from depositing on the fixed plunger 37, the anti-wear groove 39 of the fixed plunger 37 is embedded the anti-attrition ring 38 to reduce the friction loss between the fixed plunger 37 and the intermediate movable pump cylinder 8. The fixed plunger 37 between anti-wear grooves 39 and the intermediate movable pump cylinder 8 form the annular clearance, which is matched with the layered cylindrical surface moving pair 40. The upper part of the outer peripheral surface of the fixed plunger 37 is provided with the plunger capturing conical surface 41.

Figure 6:
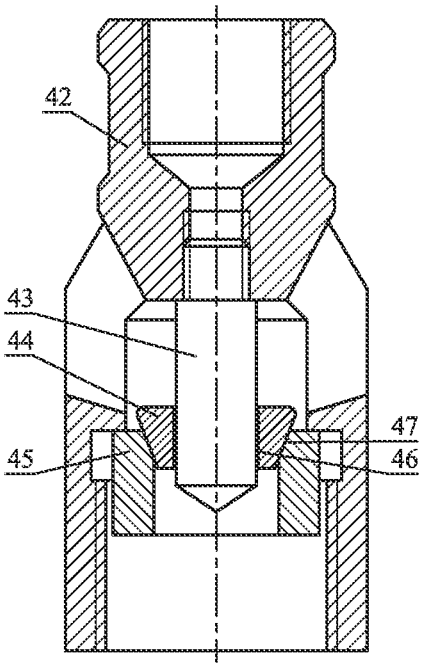
FIG. 6 is a structural sketch of the guide rod movable cone valve in the plug and valve integrated cone valve pump with combined type movable and fixed three cylinders and two spiral centralizers.
Figure 7:
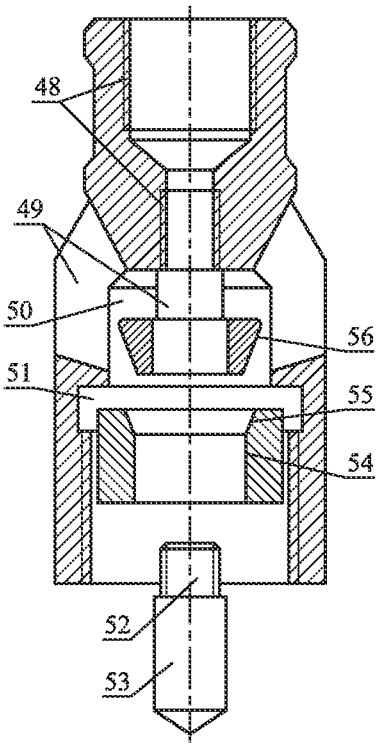
FIG. 7 is a structural sketch for the movable cone valve body, the movable cone valve seat, the movable cone valve cover and the movable cone valve guide rod in the movable cone valve guide rod.

In FIGS. 6 and 7, the guide rod movable cone valve 2 includes the movable cone valve cover 42, the movable cone valve guide rod 43, the movable cone valve body 44 and the movable cone valve seat 45. The specification of the movable cone valve cover 42 is consistent with the central rod diameter of the central rod 1, the movable cone valve body 44 is matched with the movable cone valve seat 45, the specification of the movable cone valve body 44 is selected based on the diameter of the cylindrical surface where the upper part of the annular cavity inner wall of the variable-diameter movable cylinder joint 15 is located. Factors such as liquid production capacity in the oil field and bottom hole pressure need to be considered for the design of the cross-sectional area of the movable valve hole 54 of the movable valve cover seat 45 and the sum of the cross-sectional area of each movable valve cover hole 49 of the movable cone valve cover 42.

In FIG. 6 and FIG. 7, the guide rod movable cone valve 2 opens and closes smoothly relied on the guiding function of the movable cone valve guide rod 43, which solves the problem of pump valve leakage in the highly inclined well section, and the guide rod movable cone valve 2 is opened in the down stroke and closed in the upstroke. The movable valve body sealing surface 56 of the movable cone valve body 44 and the movable valve seat sealing surface 55 of the movable cone valve seat 45 form the movable cone valve sealing annular band 47, the movable rod body 53 and the movable cone valve body 44 form the single valve cylindrical surface moving pair 46, the movable cone valve guide rod 43 realizes the guiding function relied on the single valve cylindrical surface moving pair 46, the movable cone valve guide rod 43 is connected with movable rod joint 52 and rod 1 together as a whole through the variable-diameter threaded joint 48, the movable cone valve seat 45 is placed in the movable valve seat cavity 51 and is axially fixed through the variable diameter movable fixed cylinder joint 15, the movable valve cover hole 49 is communicated with the movable valve guide cavity 50, the cross-sectional area of the movable valve hole 54 of the movable cone valve seat 45 is equal to the sum of the cross-sectional area of each movable valve cover hole 49 of the movable cone valve cover 42.

Figure 8:
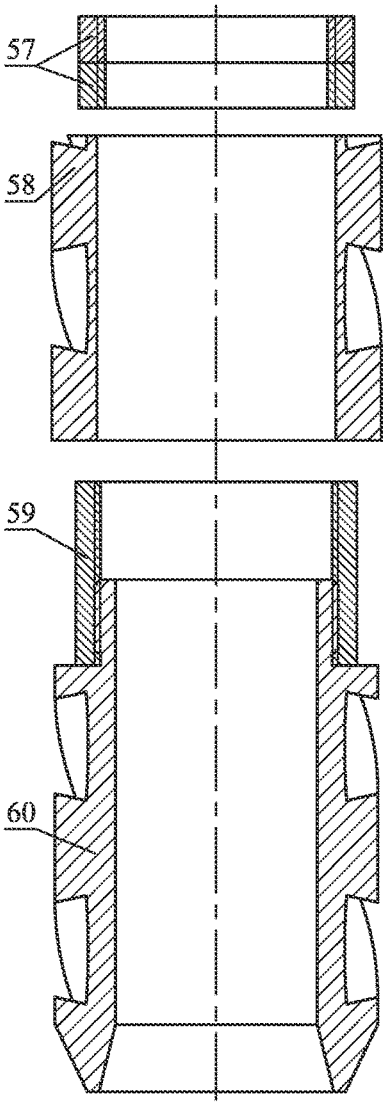
FIG. 8 is a structural sketch of the movable and fixed double-centralizer in the plug and valve integrated cone valve pump with combined type movable and fixed three cylinders and two spiral centralizers.
Figure 9:
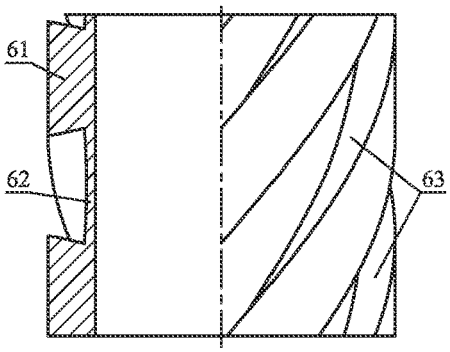
FIG. 9 is a structural sketch of the upper movable spiral body in the movable and fixed double-centralizer.
Figure 10:
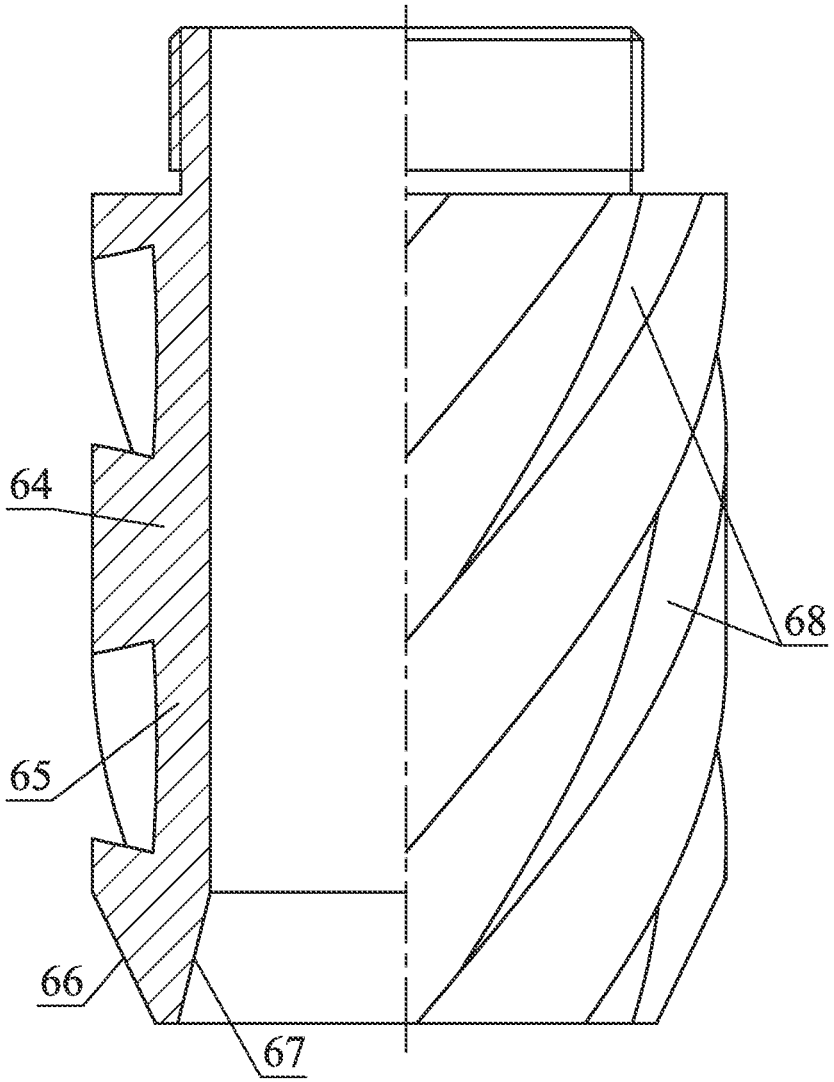
FIG. 10 is a structural sketch of the lower stationary spiral body in the movable and fixed double-centralizer.

In FIG. 8 to 10, the movable and fixed double-centralizer 5 includes the movable spiral body centering limiting collar 57, the upper movable spiral body 58, the lower movable spiral body centering coupling 59 and the lower stationary spiral body 60, the specifications of the upper movable spiral body 58 and the lower stationary spiral body 60 are consistent with the size of the ring cavity between the outer stationary pump cylinder 7 and the intermediate movable pump cylinder 8 of the movable and fixed three-cylinder body 6, and the specifications of the movable spiral body centering limiting collar 57 and the lower movable spiral body centering coupling 59 are the same as the outer diameter of the intermediate movable pump cylinder 8.

In FIGS. 8 to 10, dynamic pressure liquid films are formed between the upper movable spiral body 58 of the movable and fixed double-centralizer 5 and the outer stationary pump cylinder 7 to realize the follow-up centering of the intermediate movable pump cylinder 8, stable liquid films are formed between the tooth top surface of the lower spiral tooth body 64 of the spiral body 60 and the cylinder wall of the outer stationary pump cylinder 7 to realize the spiral centering of the intermediate movable pump cylinder 8, the lower stationary spiral body 60 drains the sand at the bottom of the outer stationary pump cylinder 7 into the desilting annular groove 12 of the pump cylinder coupling 10, so as to solve the problem of eccentric wear between the fixed plunger 37 and the intermediate movable pump cylinder 8. The movable spiral body centering limiting collar 57 realizes the upper limit of the upper movable spiral body 58, the lower movable spiral body centering coupling 59 connects the lower stationary spiral body 60 and the intermediate movable pump cylinder 8 together as a whole. The upper spiral tooth body 61 is evenly distributed on the outer peripheral surface of the upper centering base tube 62 along the circumferential direction, and the lower spiral tooth body 64 is evenly distributed on the outer peripheral surface of the lower centering base tube 65 along the circumferential direction, the upper spiral tooth body 61 drains the liquid flow carrying sand in the upper spiral tooth space 63 into the upper cylinder cavity of the intermediate movable pump cylinder 8 in time. The sectional area of the lower spiral tooth pitch 68 is gradually decreased from bottom to top along the tooth line, the centering capturing conical surface 67 of the lower stationary spiral body 60 matches the plunger catching conical surface 41 of the fixed plunger 37, and the anti-collision conical surface 66 avoids the movable and fixed double-centralizer 5 colliding the tubing string wall or the cylinder wall of the outer stationary pump cylinder 7 during the installation operation in the pit with the central rod 1.

Figure 11:
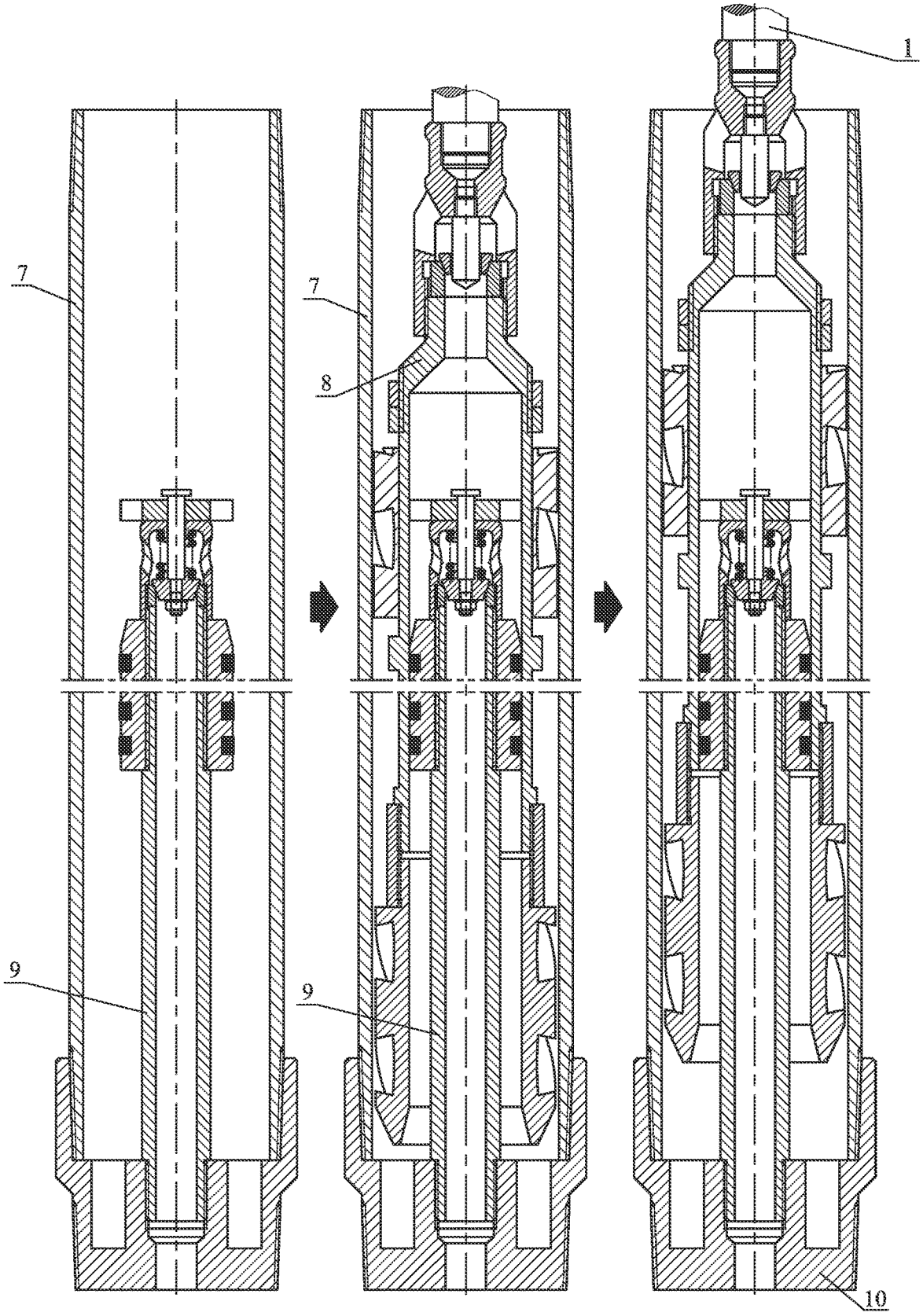
FIG. 11 is a sketch of installation operation work flow for the plug and valve integrated cone valve pump with combined type movable and fixed three cylinders and two spiral centralizers in the pit.

In FIG. 11, in the down hole installation operation process of the plug and valve integrated cone valve pump with combined type movable and fixed three cylinders and two spiral centralizers, the outer stationary pump cylinder 7, the internal stationary pump cylinder 9 and the pump cylinder coupling 10, the spring-loaded stationary cone valve 3, and the stationary plunger body 4 of the movable and fixed three-cylinder body 6 are connected to the bottom end of the tubing string and go down into the wellbore fluid production part with the tubing string, and then the intermediate movable pump cylinder 8 of the movable and fixed three-cylinder body 6, the guide rod movable cone valve 2 and the movable and fixed double-centralizer 5 are connected to the bottom end of the central rod 1 and go down the annular cavity between the outer stationary pump cylinder 7 and the internal stationary pump cylinder 9 with the central rod 1, after the plunger capturing conical surface 41 of the fixed plunger 37 is matched with the centering capturing conical surface 67 of the lower spiral body 60, the movable and fixed double-centralizer 5 quickly dock with the stationary plunger body 4 down hole, until the bottom end of the lower stationary spiral body 60 fits the pump cylinder coupling 10, the intermediate movable pump cylinder 8, guide rod movable cone valve 2 and the movable fixed double-centralizer 5 are moved up together with the central rod 1.

Figure 12:
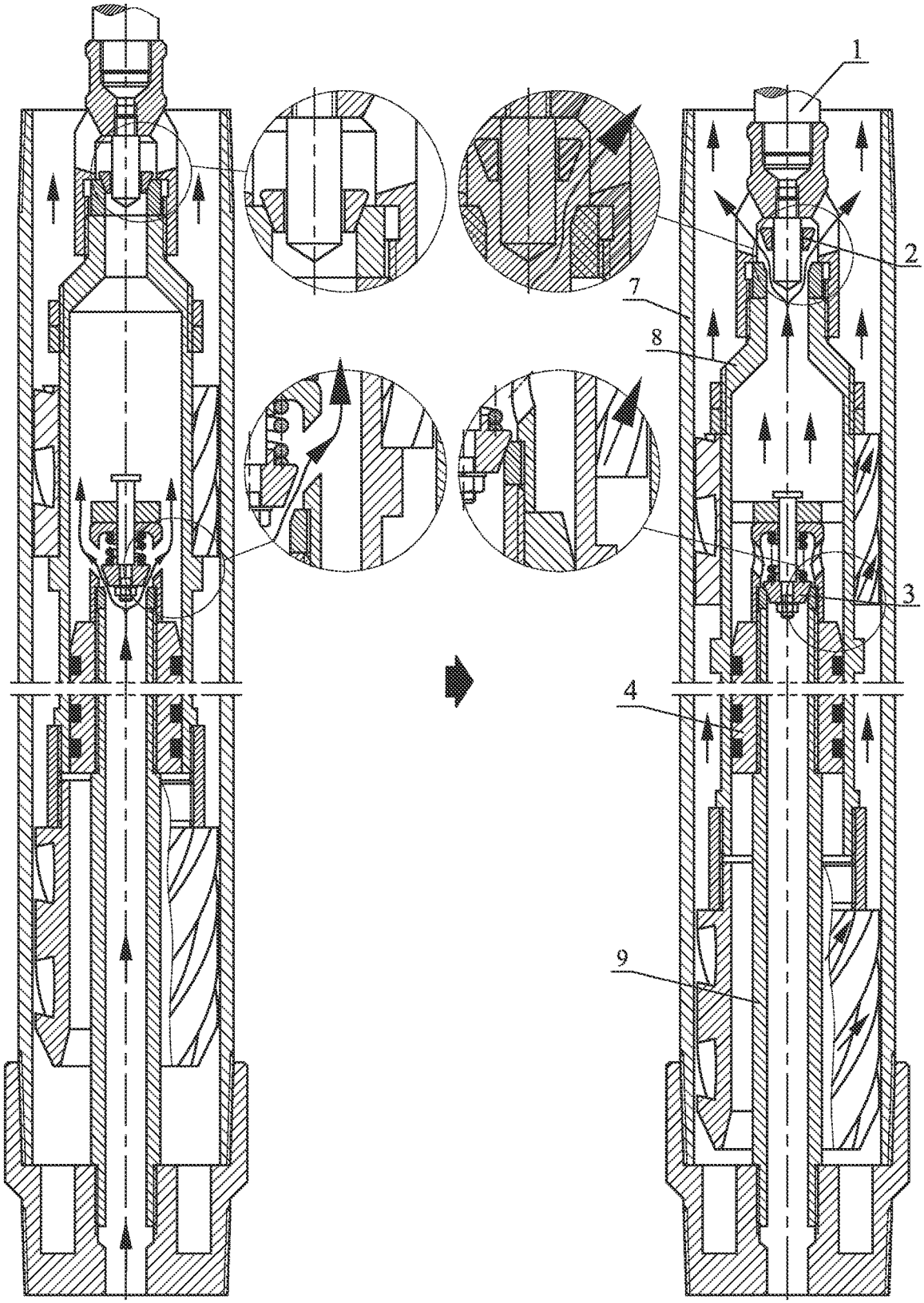
FIG. 12 is a sketch of pumping operation work flow of the plug and valve integrated cone valve pump with combined type movable and fixed three cylinders and two spiral centralizers.

In FIG. 12, in the plug-valve integrated cone valve suction operation upstroke of plug and valve integrated cone valve pump with combined type movable and fixed three cylinders and two spiral centralizers, dynamic pressure liquid films are formed between the upper movable spiral body 58 of the movable and fixed double-centralizer 5 and the outer stationary pump cylinder 7, at the same time, stable liquid films are formed between the tooth top surface of the lower spiral tooth body 64 of the spiral body 60 and the cylinder cavity of the outer stationary pump cylinder 7, the intermediate movable pump cylinder 8 of the movable and fixed three-cylinder body 6 realizes follow-up centering and spiral centering, at the same time, relied on the layered cylindrical surface moving pair 40 of the fixed plunger 37 and the single-plate cylindrical sliding pair 24 of the flow guide centering plate 17, the intermediate movable pump cylinder 8, the central rod 1, the guide rod movable cone valve 2 and the movable and fixed double-centralizer 5 accurately slide upward along the cylinder cavity of the externally stationary pump cylinder 7, and the flow pressure in the cylinder cavity of the intermediate movable pump cylinder 8 decreases, the guide rod movable cone valve 2 is in the closed state relied on the guiding function of the movable cone valve guide rod 43, and the spring-loaded stationary cone valve 3 is smoothly opened through the assists of the stationary cone valve guide rod 16 and the liquid flows through the coupling guide hole 11 into the cylinder cavity of the internal stationary pump cylinder 9, and then the liquid flows through the stationary valve hole 29 and the stationary valve guide cavity 26, and is diverted to the cylinder cavity of the intermediate movable pump cylinder 8 passed through the stationary valve cover hole 27 and the arched guide hole 23, at the same time, the liquid flow above the upper movable spiral body 58 enters the pipe cavity of the tubing string with the central rod 1.

In FIG. 12, in the plug-valve integrated cone valve suction operation down stroke of plug and valve integrated cone valve pump with combined type movable and fixed three cylinders and two spiral centralizers, dynamic pressure liquid films are formed between the upper movable spiral body 58 and the outer stationary pump cylinder 7, at the same time, stable liquid films are formed between the tooth top surface of the lower spiral tooth body 64 and the outer stationary pump cylinder 7, the intermediate movable pump cylinder 8 realizes follow-up centering and spiral centering, at the same time, relied on the layered cylindrical surface moving pair 40 and the single-plate cylindrical sliding pair 24, the intermediate movable pump cylinder 8, the central rod 1, the guide rod movable cone valve 2 and the movable and fixed double-centralizer 5 accurately slide downward along the cylinder cavity of the externally stationary pump cylinder 7. The flow pressure in the cylinder cavity of the intermediate movable pump cylinder 8 increases, the spring-loaded stationary cone valve 3 assists the stationary cone valve body 20 in the closed state through the stationary cone valve guide rod 16 and the stationary cone valve spring 19, and the guide rod movable cone valve 2 opens smoothly relied on the guiding function of the movable cone valve guide rod 43, the liquid flows through the cylinder cavity of the intermediate movable pump cylinder 8 and enters the variable-diameter movable cylinder joint 15, and then the liquid successively flows through the movable valve hole 54 and the movable valve guide cavity 50, which are decompressed and accelerated passed through the movable valve cover hole 49 and then injected into the cylinder cavity of the outer stationary pump cylinder 7, the upper spiral tooth body 61 of the upper movable spiral body 58 drains the liquid flow carrying sand in the upper spiral tooth space 63 into the upper cylinder cavity of the intermediate movable pump cylinder 8 in time, and the lower spiral tooth body 64 of the lower spiral body 60 spirally stirs the liquid flow at the bottom of the annular cavity between the outer stationary pump cylinder 7 and the internal stationary pump cylinder 9 and in time and drains the sand to the desilting annular groove 12 of the pump cylinder coupling 10.

The embodiments above are only used to illustrate the present invention, where the structure and connection mode of each component may be changed. All equivalent transformation and improvement made on the basis of the technical solution of the present invention should not be excluded from the scope of the present invention.

The invention claimed is:

1. An integral three-cylinder cone valve pump, comprising a three-cylinder body, a spring-loaded stationary cone valve, a stationary plunger body, a guide rod movable cone valve, a dual-movable-and-stationary-spiral-bodies centralizer, and a central rod;

wherein the three-cylinder body comprises an outer stationary pump cylinder, an intermediate movable pump cylinder, and an inner stationary pump cylinder that are coaxially disposed sequentially from outside to inside, wherein the guide rod movable cone valve and the dual-movable-and-stationary-spiral-bodies centralizer are disposed inside a cylinder cavity of the outer stationary pump cylinder sequentially from top to bottom; wherein the intermediate movable pump cylinder is connected to a bottom of the central rod through the guide rod movable cone valve, allowing the guide rod movable cone valve and the dual-movable-and-stationary-spiral-bodies centralizer to reciprocate up and down along with the central rod; wherein the spring-loaded stationary cone valve and the stationary plunger body are disposed inside a cylinder cavity of the intermediate movable pump cylinder sequentially from up to bottom; the spring-loaded stationary cone valve and the stationary plunger body are integrally formed and they are connected together to the inner stationary pump cylinder; wherein the outer stationary pump cylinder and the inner stationary pump cylinder are fixedly connected together at a bottom of a tubing string through a pump cylinder coupling; wherein a base portion of the pump cylinder coupling defines a coupling guide round hole and a desilting annular groove that are positioned radially from inside to outside;

wherein the spring-loaded stationary cone valve comprises a stationary cone valve guide rod, a flow guide centering plate, a stationary cone valve hood, a stationary cone valve spring, and a stationary cone valve body, and a stationary cone valve seat, wherein outer peripheral surface of the stationary cone valve body comprises a lower spring clamping slot and a stationary valve body sealing surface sequentially from top to bottom, wherein an inner wall of an annular cavity of the stationary cone valve seat comprises a stationary valve seat sealing surface and a stationary valve hole along an axial direction sequentially from top to bottom, wherein the stationary cone valve body and the stationary cone valve seat match with each other and operate in conjunction, wherein a stationary cone valve sealing annular band is formed between the stationary valve body sealing surface and the stationary valve seat sealing surface, wherein a base portion of the stationary cone valve hood defines an upper spring clamping slot, and the stationary cone valve spring is arranged between the upper spring clamping slot and the lower spring clamping slot; wherein the spring-loaded stationary cone valve realizes axial alignment through a stationary cone valve seat cavity of the stationary cone valve hood and the inner stationary pump cylinder;

wherein the stationary cone valve guide rod comprises a stationary rod cover, a stationary rod body, and a stationary rod joint that are disposed along an axial direction sequentially from top to bottom, wherein the stationary rod joint connected the stationary cone valve guide rod and the stationary cone valve body together through a thread, wherein the stationary rod body passes through the flow guide centering plate and the stationary cone valve hood to form a dual valve cylinder moving pair between the flow guide centering plate and the stationary cone valve hood;

wherein the flow guide centering plate is disposed in a cylinder cavity of the intermediate movable pump cylinder and forms a single plate cylinder moving pair between inner walls of the intermediate movable pump cylinder, wherein a central part of the flow guide centering plate is drilled with a round hole and wherein arched guide holes are provided surrounding the flow guide centering plate and are circumferentially and uniformly distributed;

wherein the stationary cone valve guide rod and the stationary cone valve spring operate in conjunction to facilitate the opening and closing of the stationary cone valve body;

wherein the stationary cone valve body is fixed to and sleeved on the inner stationary pump cylinder, wherein the stationary plunger body comprises a fixed plunger and an anti-wear ring, wherein an outer peripheral surface of the fixed plunger comprises a plunger capturing conical surface and at least one anti-wear groove that are sequentially disposed from top to bottom along an axial direction, wherein the at least one anti-wear groove is inlaid with an anti-wear ring, wherein an annular clearance is defined between the fixed plunger and the intermediate movable ump cylinder, and matching to a layered cylinder surface moving pair;

wherein the guide rod movable cone valve comprises a movable cone valve body, a movable cone valve seat, a movable cone valve cover, and a vale movable cone valve guide rod, wherein an outer peripheral surface of the movable cone valve body comprises movable valve body sealing surface, wherein an inner wall of an annular cavity of the movable cone valve seat comprises a movable valve seat sealing surface and a movable valve hole that are sequentially positioned from top to bottom along an axial direction, wherein a movable cone valve sealing annular band is formed between the movable valve body sealing surface and the movable valve seat sealing surface, wherein the guide rod movable cone valve is disposed inside a movable cone valve seat cavity of the movable cone valve cover, wherein an upper portion of the movable cone valve guide rod is threadedly connected with the movable cone valve cover, and a lower portion of the movable cone valve guide rod passes through the movable cone valve body to form a single valve cylinder moving pair with the movable cone valve body; wherein the guide rod movable cone valve is connected with the intermediate movable pump cylinder through the movable cone valve cover, and wherein the movable cone valve cover comprises a movable valve guide cavity and a movable valve cover hole intercommunicated with each other;

wherein the guide rod movable cone valve is driven to operate and stop operating by a guiding action of the movable cone valve guide rod;

wherein the dual-moveable-and-stationary-spiral-bodies centralizer comprises an upper movable spiral body, a lower stationary spiral body, a upper movable spiral body limiting collar, and a lower movable spiral body centering coupling; wherein the upper movable spiral body is a rotary spiral tooth impeller consisting of an upper spiral tooth body and an upper centering base tube; the lower stationary spiral body is a stationary spiral tooth impeller consisting of a lower spiral tooth body and a lower centering base tube; wherein a tooth pitch of spiral teeth of the upper spiral tooth body gradually decreases from bottom to top along the respective tooth line, and a cross-sectional area of a lower spiral tooth gap between spiral teeth of the lower spiral tooth body gradually decreases from bottom to top along the respective tooth line;

wherein a stable liquid film is disposed between a tooth top surface of the lower spiral tooth body and an inner cylinder wall of the outer stationary pump cylinder; wherein a dynamic pressure liquid film is disposed between the upper movable spiral body and the outer stationary pump cylinder;

wherein a lower end of the of the lower centering base tube of the lower stationary spiral body comprises a centering capturing conical surface which matches with the plunger capturing conical surface of the fixed plunger, realizing quick down-hole docking between the dual-movable-and-stationary-spiral-bodies centralizer and the stationary plunger body; wherein a spiral tooth top surface of the lower spiral tooth body comprises an anti-collision conical surface, wherein the upper movable spiral body limiting collar is used to achieve upper limiting of the upper movable spiral body, and the lower movable spiral body centering coupling is used to connect the lower stationary spiral body to the intermediate movable pump cylinder so as to form an integral assembly;

wherein the intermediate movable pump cylinder comprises a variable-diameter movable tube joint, an upper cylinder limiting collar, and a lower cylinder limiting collar that are sequentially disposed from top to bottom along the axial direction, wherein the intermediate movable pump cylinder and the guide rod cone valve are axially aligned and fixed through the variable-diameter movable tube joint; wherein the upper cylinder limiting collar is used to realize lower limiting of the upper movable spiral body, and the lower cylinder limiting collar is used to realize axial alignment of the dual movable-cylinder-to-stationary-cylinder centralizer;

wherein a diameter of a cylinder where an upper portion of an inner wall of an annular cavity of the variable-diameter movable tube joint is disposed is equal to an aperture of the movable valve hole of the movable cone valve seat, and wherein a cylinder where a lower portion of an inner wall of an annular cavity of the variable-diameter movable tube joint is disposed on a same cylindrical surface as an inner wall of an annular cavity of the intermediate movable pump cylinder; wherein the intermediate movable pump cylinder is operative to precisely slidably reciprocate along a cylinder cavity of the outer stationary pump cylinder depending on the levered cylinder surface moving pair and the single plate cylinder moving pair in conjunction with the dynamic pressure liquid film and the stable liquid film.

2. The integral three-cylinder cone valve pump according to claim 1, wherein the stationary cone valve hood is a round box body with an downward opening, wherein both the upper spring clamping slot and the lower spring clamping slot each match with the stationary cone valve spring, wherein an inner wall of an annular cavity of the stationary cone valve hood comprises a fixed valve seat stationary valve seat cavity, a stationary valve guide cavity, and stationary valve cover holes that are sequentially disposed from top to bottom along the axial direction, wherein the stationary valve cover holes are circular pore canals that are circumferentially and uniformly distributed, wherein a liquid flow in the inner stationary pump cylinder is allowed to flow through the stationary valve holes and the stationary valve guide cavity in turn, and be drained by the stationary valve cover holes and the arched guide holes to the cylinder cavity of the intermediate movable pump cylinder;

wherein an outer peripheral surface of the stationary rod body is precisely fitted with a round hole wall of a base portion of the stationary cone valve hood and a round hole wall of the flow guide centering plate, wherein the stationary cone valve guide rod is operative to perform a precise reciprocating slide depending on the dual valve cylinder moving pair, wherein a shaft shoulder is formed at a joint of the stationary rod cover and the stationary rod body, wherein a gap is maintained between the shaft shoulder and an upper end face of the flow guide centering plate; wherein an outer peripheral surface of the flow guide centering plate is precisely fitted with the inner wall of the annular cavity of the intermediate movable pump cylinder, wherein a cross section along an axial direction of each of the arched guide holes is formed as a combination of semicircles and rectangles, wherein a sum of sectional areas of the arched guide holes is equal to a sum of sectional areas of the stationary valve holes and sectional areas of the stationary valve cover holes.

3. The integral three-cylinder cone valve pump according to claim 1, wherein a compression spring is used for the stationary cone valve hood, and wherein a maximum elastic force is equal to a sum of a gravitational force acted on the stationary cone valve body and a gravitational force acted on the stationary cone valve guide rod;

wherein the stationary valve body sealing surface and the stationary valve seat sealing surface use inverted conical surfaces with an identical taper angle, wherein a diameter of a round circular surface of a relatively larger end of the conical surface where the stationary valve body sealing surface is located is less than a diameter of a cylinder where a cavity wall of the stationary valve guide cavity is located, and a diameter of a circular surface of a relatively smaller end o the conical surface where the stationary valve body sealing surface is located is less than the aperture of the stationary valve hole, wherein a variable diameter rotary surface is used for the inner wall of the annular cavity of the stationary cone valve body, and matches with the stationary rod joint;

wherein the stationary cone valve seat is a annular ring body, wherein the stationary valve seat sealing surface is precisely fitted with the stationary valve body sealing surface, wherein a width of the stationary cone valve sealing annular band is greater than a third of a cone height of the conical surface where the stationary valve body sealing surface is located.

4. The integral three-cylinder cone valve pump according to claim 1, wherein an inner wall of an annular cavity of the fixed plunger is formed with a thread and is connected to an upper portion of the inner stationary pump cylinder, wherein a profile of the anti-wear groove has a rectangular shape, wherein the anti-wear grooves are arranged in a layered manner at equal intervals, wherein an outer annular wall surface of the fixed plunger between every two adjacent layers of anti-wear grooves is fitted with the inner wall of the annular cavity of the intermediate movable pump cylinder; wherein a material of the anti-wear ring is an anti-friction alloy, wherein a diameter of a cylinder where the outer peripheral surface of the anti-wear ring is disposed is identical with a size of an annular clearance between the intermediate movable pump cylinder and the fixed plunger, and wherein the outer peripheral surface of the anti-wear ring is closely fitted with the inner wall of the annular cavity of the intermediate movable pump cylinder.

5. The integral three-cylinder cone valve pump according to claim 1, wherein a thin-walled cylinder body is used for the movable cone valve cover, wherein an inner wall of an annular cavity of the movable cone valve seat comprises a movable valve seat cavity, a movable valve guide cavity, a movable valve cover hole, and a variable-diameter threaded joint that are sequentially disposed from top to bottom along an axial direction, wherein both ends of the variable-diameter threaded joint are each formed with a thread with different nominal diameters, wherein a cylindrical surface is used for a cavity wall of the movable valve guide cavity, wherein conical pore canals are used for the movable valve cover holes and are circumferentially and uniformly distributed, wherein a liquid flow in the intermediate movable pump cylinder is allowed to flow through the movable valve hole and the movable valve guide cavity in turn, and thereafter be injected into a cylinder cavity of the outer stationary pump cylinder after depression and speedup by the movable valve cover hole, thus avoiding sand deposition;

wherein the movable cone valve guide rod comprises a movable rod body and a movable rod joint that are sequentially disposed from top to bottom along an axial direction, wherein an outer peripheral surface of the movable rod body is precisely fitted with an inner wall of an annular cavity of the movable cone valve body, wherein the movable cone valve guide rod is used to provide a guiding effect depending on the single valve cylinder moving pair.

* * * * *